US008636851B2

(12) United States Patent
Rosenbauer et al.

(10) Patent No.: US 8,636,851 B2
(45) Date of Patent: Jan. 28, 2014

(54) DISHWASHER COMPRISING AUTOMATICALLY CLEANING WASHING LIQUID LINES

(75) Inventors: Michael Rosenbauer, Reimlingen (DE); Bernd Schessl, Dillingen/Donau (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1278 days.

(21) Appl. No.: 11/587,026

(22) PCT Filed: Apr. 21, 2005

(86) PCT No.: PCT/EP2005/051767

§ 371 (c)(1),
(2), (4) Date: Jun. 22, 2007

(87) PCT Pub. No.: WO2005/102140

PCT Pub. Date: Nov. 3, 2005

(65) Prior Publication Data

US 2007/0256708 A1 Nov. 8, 2007

(30) Foreign Application Priority Data

Apr. 21, 2004 (DE) ..... 10 2004 019 334

(51) Int. Cl.
*B08B 3/00* (2006.01)

(52) U.S. Cl.
USPC .... 134/56 D; 134/56 R; 134/57 R; 134/57 D; 134/58 R; 134/58 D; 15/3

(58) Field of Classification Search
USPC ..... 134/56 R–58 DL
See application file for complete search history.

(56) References Cited

U.S. PATENT DOCUMENTS

| | | | | |
|---|---|---|---|---|
| 3,858,595 | A * | 1/1975 | Schultz et al. | 134/47 |
| 5,264,043 | A * | 11/1993 | Milocco | 134/25.2 |
| 5,803,985 | A * | 9/1998 | Alvord | 134/18 |
| 7,047,986 | B2 * | 5/2006 | Ertle et al. | 134/56 D |

FOREIGN PATENT DOCUMENTS

| | | |
|---|---|---|
| DE | 1 528 747 | 9/1970 |
| DE | 25 25 454 | 3/1976 |
| EP | 0 852 928 | 7/1998 |
| EP | 1 042 982 | * 10/2000 |
| JP | 4-361729 | * 12/1992 |
| WO | WO 03/053211 | * 7/2003 |

OTHER PUBLICATIONS

Definition of "line", Cambridge Dictionary.*
Definition of "opening", Cambridge Dictionary.*
International Search Report PCT/EP2005/051767.
National Search Report DE 10 2004 019 334.7.

* cited by examiner

*Primary Examiner* — Eric Golightly
(74) *Attorney, Agent, or Firm* — James E. Howard; Andre Pallapies

(57) ABSTRACT

A dishwasher is provided, wherein the protruding wash residues can be automatically cleaned in the most efficient manner possible in the washing liquid lines, in order to maintain the cleaning effect of the washing device. The dishwasher comprises at least one washing compartment, and a washing device that is used to spray the liquid into the inner chamber of the washing container, in addition to at least one washing liquid line which is used to supply the liquid to the cleaning device. The washing liquid line comprises at least one first opening and one second opening that is arranged at a distance from the first opening, over which the respective alternative cleaning liquid can be supplied in a pressurized manner.

21 Claims, 1 Drawing Sheet

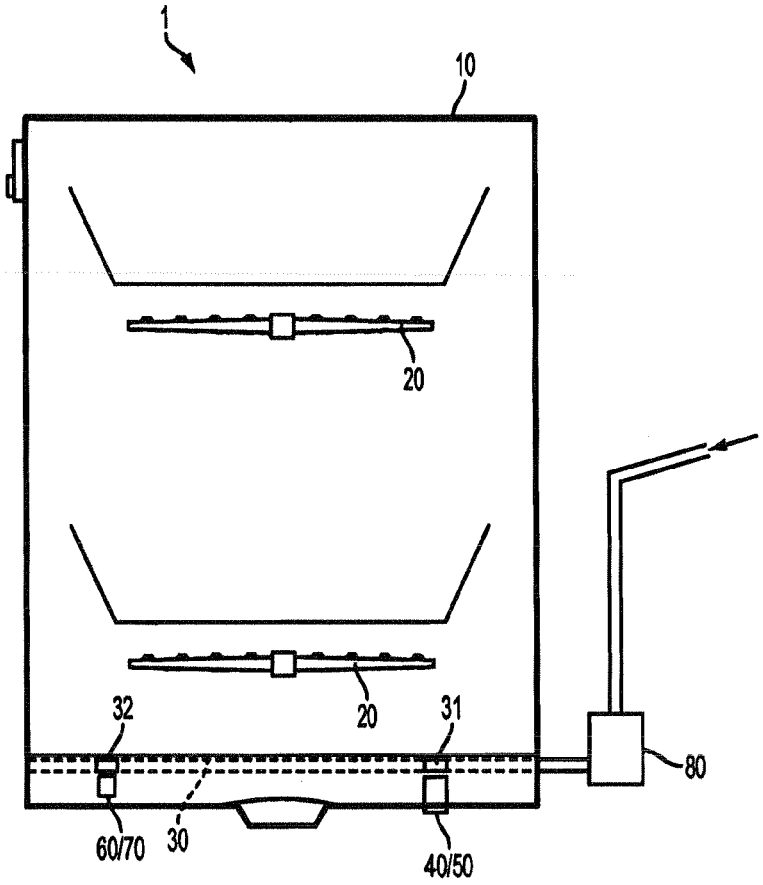
1
10
20
20
32
31
80
60/70
30
40/50

DISHWASHER COMPRISING AUTOMATICALLY CLEANING WASHING LIQUID LINES

BACKGROUND OF THE INVENTION

The invention relates to a dishwasher comprising washing liquid lines for conveying washing liquid to spray devices for spraying washing liquid onto items to be washed and in particular a method for self-cleaning of washing liquid lines in dishwashers.

Dishwashers with spray devices are known wherein the washing liquid is sprayed onto the items to be cleaned during the washing mode by means of spray devices, such as rotating spray arms, for example. For this purpose, the washing liquid is supplied to the rotating spray arms by a circulating pump via washing liquid lines and the liquid emerges under pressure from spray nozzles and impinges upon the items to be washed. In conventional dishwashers the circulating pump can usually only be operated in one direction of rotation so that the washing liquid only flows in one direction through the washing liquid lines and the spray device. The washing liquid circulated during the washing mode also entrains wash residues which can be deposited in the washing liquid lines and in the spray devices, which can hinder the flow of washing liquid to the extent of causing blockages of the washing liquid lines and spray devices.

Known from DE 197 02 982 is a dishwasher wherein during the washing mode washing liquid is pumped into rotating spray arms via washing liquid lines by a circulating pump. During a pumping-out mode the washing liquid is conveyed from the dishwasher by a drain pump, the circulating pump being temporarily operated in the opposite direction of rotation in order to completely extract the washing liquid from the washing liquid lines and the spray arms. This dishwasher has the disadvantage that during the pumping-out mode washing liquid is merely removed from the washing liquid lines and the spray arms without achieving any cleaning effect in the washing liquid lines.

BRIEF SUMMARY OF THE INVENTION

It is therefore the object of the present invention to provide a dishwasher with a spray device for acting upon items to be washed with washing liquid, wherein wash residues can be automatically cleaned as efficiently as possible from washing liquid lines in order to maintain the cleaning action of the spray arms. It is further the object of the invention to provide a method for operating a dishwasher having the aforesaid properties whereby wash residues can be automatically cleaned as efficiently as possible from washing liquid lines in order to maintain the cleaning action of the spray arms.

BRIEF DESCRIPTION OF THE DRAWINGS

FIG. 1 depicts a dishwasher according to an exemplary embodiment of the invention.

The dishwasher 1 according to the invention comprises at least one washing container 10, a spray device 20 for spraying washing liquid into the interior of the washing container 10 and at least one washing liquid line 30 for supplying washing liquid to the spray device 20, the washing liquid line 30 comprising at least one first opening 31 and a second opening 32 at a distance therefrom, via which washing liquid can be supplied alternately under pressure.

DETAILED DESCRIPTION OF EXEMPLARY EMBODIMENTS OF THE PRESENT INVENTION

Since in the dishwasher according to the invention, two openings are provided in the washing liquid line for supplying washing liquid, the washing liquid can be supplied under pressure either via one or via the other opening of the washing liquid line. As a result, washing liquid does not always flow under pressure through the washing liquid line in the same direction but at least temporarily in the opposite direction. The alternating direction of flow of the washing liquid in the washing liquid line efficiently and automatically cleans wash residues from the washing liquid line so that the flow of washing liquid is not hindered by wash residues and thus the overall cleaning action of the spray device is maintained. In this way, the washing liquid lines are freed from wash residues in a type of self-cleaning process.

In a preferred embodiment of the dishwasher according to the invention, the washing liquid line has two open ends in each case so that the washing liquid can either be supplied under pressure from one or from the other side, thereby achieving a flow of liquid through the washing liquid line in different directions. During the washing mode, the washing liquid is supplied through one open end of the washing liquid line and further to the spray device of the dishwasher whereas during the self-cleaning process the washing liquid is supplied through the other open end of the washing liquid line, whereby the washing liquid is preferably removed from the spray device of the dishwasher.

According to a further preferred embodiment of the dishwasher according to the invention, the washing liquid line 30 has a number of openings 31, 32, 33, . . . for supplying washing liquid under pressure. As a result of the arrangement of a number of openings along the washing liquid line for supplying washing liquid under pressure, the washing liquid line can be divided into a plurality of sections through which washing liquid can flow either in one or in the other direction as a result of a corresponding choice of openings for supplying washing liquid under pressure. In this way, in particular those sections of the washing liquid line which are particularly susceptible to the deposition of wash residues, can be subjected to a self-cleaning process.

Appropriately provided at least in the dishwasher according to the invention is at least one water diverter 40 which regulates the supply of washing liquid to the washing liquid line 30. For this purpose, for example, in a first position of the water diverter 40, the washing liquid is supplied under pressure via the first opening of the washing liquid line 31 and in a second position of the water diverter 40, the washing liquid is supplied under pressure via the second opening of the washing liquid line 32. Optionally, the water diverter 40 thereby also regulates the pressure build-up and the pressure reduction of the washing liquid supplied to the washing liquid line 30. The pressure build-up and the pressure reduction of the washing liquid supplied to the washing liquid line 30 can take place, for example, in a pulsed mode in order to remove wash residues from the washing liquid line 30 as efficiently as possible.

In a further preferred embodiment of the dishwasher, a water diverter 50 is provided at the first opening of the washing liquid line and respectively one water diverter 60 or a valve 70 is provided at the second opening of the washing liquid line, which regulate the supply of washing liquid to the washing liquid line. In this way, washing liquid can be supplied under pressure independently to the two openings in the washing liquid line.

It is particularly advantageous if the pressure at which the washing liquid is supplied to the washing liquid line can be varied. As a result, the washing liquid lines can be automatically cleaned in a self-cleaning process by alternating exposure to washing liquid as required at higher or lower pressure.

The washing liquid is appropriately supplied to the spray channel by a pump device, in particular by the circulating pump 80 of the dishwasher. According to a further preferred embodiment of the dishwasher, the speed or pumping capacity of the circulating pump can be varied. As a result of the variability of the speed and therefore the pumping capacity of the circulating pump, the intensity of the spray jets emerging from the spray device can also be varied.

According to a particularly advantageous embodiment of the dishwasher according to the invention, the washing liquid is supplied under pressure to the washing liquid line by means of a circulating pump which can be operated in opposite directions of rotation. By means of corresponding settings of the valves or water diverters, the washing liquid can then be supplied under pressure to the washing liquid line through the first opening or via the open end when the circulating pump is operated in one direction of rotation and through the second opening or via the other open end when the circulating pump is operated in the opposite direction of rotation.

The aforesaid objects are also achieved according to the present invention by a method for operating a dishwasher at least comprising the following steps:

supplying washing liquid under pressure to a washing liquid line via a first opening in the washing liquid line during a washing mode of the dishwasher, supplying washing liquid under pressure to a washing liquid line via a second opening in the washing liquid line during a self-cleaning mode of the dishwasher.

As a result of washing liquid being supplied under pressure and acting upon the washing liquid line either via one opening or via the other opening in the washing liquid line, washing liquid does not always flow through the washing liquid line in the same direction but during the self-cleaning process washing liquid also flows in the opposite direction. The alternating direction of flow of the washing liquid in the washing liquid line automatically cleans wash residues from the washing liquid line during the self-cleaning process so that the flow of washing liquid is not hindered by wash residues and thus the overall cleaning action of the spray device is maintained.

In a preferred embodiment of the method according to the invention, the washing liquid is supplied under pressure to the washing liquid line during the washing mode by means of a water diverter via the first opening in the washing liquid line by bringing the water diverter into a first position, the washing liquid being guided further to the spray device by the washing liquid line; during the self-cleaning mode, however, the washing liquid is supplied under pressure to the washing liquid line via the second opening in the washing liquid line, by bringing the water diverter into a second position. It is also possible that the water diverter is embodied in such a manner that it can be varied between the first and the second position in a periodic to-and-fro movement. The periodic to-and-fro movement of the water diverter also alternately changes the direction of flow of the washing liquid in the washing liquid line.

The washing liquid is appropriately supplied via the water diverter in each case through the open ends of the washing liquid line, so that the washing liquid is supplied under pressure to the washing liquid line during the washing mode via one open end of the washing liquid line when the water diverter is in the first position, the washing liquid then being further guided to the spray device of the dishwasher by the washing liquid line. During the self-cleaning mode the washing liquid is supplied under pressure to the washing liquid line via the other open end of the washing liquid line when the water diverter is in the second position, the washing liquid being removed from the spray device of the dishwasher.

In a further preferred embodiment of the method according to the invention, the washing liquid is supplied under pressure to the washing liquid line by means of a circulating pump which can be operated in opposite directions of rotation. During the washing mode the circulating pump is operated in a first direction of rotation and during the self-cleaning mode it is operated in the opposite direction of rotation to supply the washing liquid line with washing liquid under pressure. By means of corresponding settings of valves or water diverters, the washing liquid is then supplied under pressure to the washing liquid line through the first opening or via one open end when the circulating pump is operated in one direction of rotation and the washing liquid is supplied under pressure through the second opening or via the other end when the circulating pump is operating in the opposite direction of rotation.

According to a further preferred embodiment of the method according to the invention, the washing liquid is supplied under pressure to the washing liquid line during the self-cleaning mode by means of the circulating pump by operating the circulating pump with alternating direction of rotation. In this way, the direction of flow of the washing liquid in the washing liquid line can be arbitrarily changed during the self-cleaning mode which enhances the cleaning effect for the removal of wash residue from the washing liquid line. At the same time, corresponding settings of valves or water diverters prevent the washing liquid from entering into the spray device of the dishwasher during the self-cleaning mode so that the wash residues released from the washing liquid line cannot become deposited in he spray device.

In this case, it is particularly advantageous if the speed or the pumping capacity of the circulating pump is increased during the self-cleaning mode. By this means a correspondingly more intensive self-cleaning process can be carried out as required, i.e. depending on the degree of deposition of wash residue in the washing liquid line.

The invention claimed is:

1. A dishwasher comprising:

at least one washing container;

a spray device for spraying washing liquid into an interior of the at least one washing container; and at least one washing liquid line in fluid communication with the spray device to supply washing liquid to the spray device, the at least one washing liquid line including at least one first opening to the at least one washing liquid line and a second opening to the at least one washing liquid line at a distance from the first opening, wherein washing liquid is supplied to the at least one washing liquid line under pressure alternately through one of the openings and then through another of the openings, and wherein the washing liquid flows to the spray device through at least one common portion of the at least one washing liquid line from the first opening and from the second opening.

2. The dishwasher according to claim 1, wherein the washing liquid line has a number of openings for supplying washing liquid under pressure.

3. The dishwasher according to claim 1 and further comprising at least one water diverter that regulates a supply of washing liquid to the washing liquid line.

4. The dishwasher according to claim 3, wherein, in a first position of the water diverter, the washing liquid is supplied under pressure via the first opening of the washing liquid line and in a second position of the water diverter, the washing liquid is supplied under pressure via the second opening of the washing liquid line.

5. The dishwasher according to claim 3, wherein the water diverter is provided at the first opening of the washing liquid line and a selected one of a one water diverter and a valve is provided at the second opening of the washing liquid line that regulates the supply of washing liquid to the washing liquid line.

6. The dishwasher according to according to claim 1, wherein the washing liquid line is operable to receive washing liquid supplied thereto under varying pressures.

7. The dishwasher according to claim 1, wherein the washing liquid line is operable to receive washing liquid supplied thereto under pressure by a circulating pump whose speed or pumping capacity can be varied.

8. The dishwasher according to claim 1, wherein the washing liquid line is operable to receive washing liquid supplied thereto under pressure by a circulating pump which can be operated in opposite directions of rotation.

9. A dishwasher comprising:

a washing container;

a spray device to spray washing liquid onto items to be washed;

a washing liquid line to supply washing liquid to the spray device;

a first opening disposed on the washing liquid line to provide a first flow of washing liquid to said washing liquid line; and a second opening disposed on the washing liquid line to provide a second flow of washing liquid to said washing liquid line, said second opening being separate from said first opening, wherein said first flow of washing liquid and said second flow of washing liquid are in opposite directions through at least one common portion of the washing liquid line, and wherein said first flow of washing liquid and said second flow of washing liquid flow alternately through the washing liquid line.

10. The dishwasher according to claim 9, further comprising:

at least one water diverter to regulate the flow of washing liquid to the washing liquid line.

11. The dishwasher according to claim 10, wherein in a first position of the at least one water diverter the first flow of the washing liquid to the washing liquid line is provided through the first opening and in a second position of the at least one water diverter the second flow of the washing liquid to the washing liquid line is provided through the second opening.

12. The dishwasher according to claim 10, wherein a water diverter is provided at each of the first opening and the second opening.

13. The dishwasher according to claim 9, further comprising a pump to supply washing liquid to the washing liquid line through at least the first opening and the second opening.

14. The dishwasher according to claim 13, wherein the pump is configured to supply washing liquid at varying pressures.

15. The dishwasher according to claim 13, wherein the pump is configured to supply washing liquid in opposite directions to alternately supply the first flow through the first opening or the second flow through the second opening.

16. A method for operating a dishwasher comprising:

supplying a first flow of washing liquid under pressure to a first opening disposed on a washing liquid line then through the washing liquid line and to a spray device during a washing mode of the dishwasher, the spray device spraying the washing liquid into an interior of at least one washing container; and supplying a second flow of washing liquid under pressure to a second opening, the second opening disposed on the washing liquid line at a distance from the first opening, then through the washing liquid line and to the spray device during a self- cleaning mode of the dishwasher, the spray device spray washing liquid into the interior of the at least one washing container, wherein the first flow and the second flow of the washing liquid flows alternately in opposite directions to the spray device under pressure through at least one common portion of the washing liquid line from the first opening and from the second opening, respectively.

17. The method for operating a dishwasher according to claim 16, wherein the first flow of washing liquid is supplied under pressure to the washing liquid line during the washing mode by a water diverter via the first opening in the washing liquid line by bringing the water diverter into a first position and the second flow of washing liquid is supplied under pressure to the washing liquid line during the self-cleaning mode via the second opening in the washing liquid line, by bringing the water diverter into a second position.

18. The method for operating a dishwasher according to claim 17, wherein the first flow of washing liquid and the second flow of washing liquid are supplied via the water diverter through open ends of the washing liquid line, by supplying the washing liquid under pressure to the washing liquid line during the washing mode via a first open end of the washing liquid line when the water diverter is in the first position and supplying the washing liquid under pressure to the washing liquid line via a second open end of the washing liquid line when the water diverter is in the second position.

19. The method for operating a dishwasher according to claim 16, wherein the first flow of washing liquid is supplied under pressure to the washing liquid line during the washing mode by a circulating pump operable in opposite directions of rotation by operating the circulating pump in a first direction of rotation and supplying the second flow of washing liquid under pressure to the washing liquid line during the self-cleaning mode by operating the circulating pump in a second direction of rotation, the second direction being opposite the first direction.

20. The method for operating a dishwasher according to claim 19, wherein the second flow of washing liquid is supplied under pressure to the washing liquid line during the self-cleaning mode by the circulating pump by operating the circulating pump in alternating directions of rotation.

21. The method for operating a dishwasher according to claim 19, wherein a speed or a pump capacity of the circulating pump is increased during the self-cleaning mode.

* * * * *

UNITED STATES PATENT AND TRADEMARK OFFICE

CERTIFICATE OF CORRECTION

PATENT NO. : 8,636,851 B2
APPLICATION NO. : 11/587026
DATED : January 28, 2014
INVENTOR(S) : Rosenbauer et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1545 days.

Signed and Sealed this
Twenty-second Day of September, 2015

Michelle K. Lee

Michelle K. Lee
*Director of the United States Patent and Trademark Office*